United States Patent [19]

Hickey

[11] Patent Number: 4,651,024

[45] Date of Patent: Mar. 17, 1987

[54] ELECTROMAGNETICALLY ACTUATED HIGH DC CURRENT SWITCH

[75] Inventor: John S. Hickey, Burnt Hills, N.Y.

[73] Assignee: General Electric Company, Pittsfield, Mass.

[21] Appl. No.: 803,261

[22] Filed: Nov. 27, 1985

[51] Int. Cl.[4] ..... F41F 1/02

[52] U.S. Cl. ..... 307/147; 307/143; 89/8; 200/150 C; 200/148 R; 200/144 R; 124/3

[58] Field of Search ..... 307/147, 143; 200/144 R, 144 A, 144 AP, 147 R, 148 R, 148 C, 148 E, 148 F, 148 G, 150 C; 74/513, 482; 435/1; 89/8; 124/3; 335/2; 313/113, 231.41; 361/160; 376/107, 108

[56] References Cited

U.S. PATENT DOCUMENTS

| | | | |
|---|---|---|---|
| 2,644,877 | 7/1953 | Guillaume | 200/150 C |
| 3,708,643 | 1/1973 | Erickson | 200/144 R |
| 3,947,649 | 3/1976 | Hertz | 200/144 R |
| 4,125,750 | 11/1978 | Cochran | 200/144 R |
| 4,369,692 | 1/1983 | Kemeny | 124/3 X |
| 4,426,562 | 1/1984 | Kemeny | 200/150 C X |
| 4,433,607 | 2/1984 | Kemeny | 89/8 |
| 4,528,433 | 7/1985 | Riggins et al. | 200/144 R X |

*Primary Examiner*—William M. Shoop, Jr.
*Assistant Examiner*—Shik Luen Paul Ip
*Attorney, Agent, or Firm*—Bailin L. Kuch; Robert A. Cahill

[57] ABSTRACT

A high DC current switch includes a pair of annular, conductive rails with a pair of brushes mounted for rotary movement therebetween. DC current is conducted by the rails to and from the brushes in directions to electromotively accelerate the brushes into a switching cycle. The rails incorporate a switching gap through which the brushes move. Beyond this switching gap, the rails are split into inner and outer arcuate sections into which current is commutated by the brushes. The directions of commutated current flow to and from the brushes is now such as to decelerate the brushes to a stop.

16 Claims, 4 Drawing Figures

ELECTROMAGNETICALLY ACTUATED HIGH DC CURRENT SWITCH

BACKGROUND OF THE INVENTION

The present invention relates to electrical switches and particularly to a fast acting switch for commutating ultra-high DC currents.

A particular application calling for the switching of DC currents of extremely high magnitudes is in electromagnetic accelerators operating to propel a mass to very high velocities. Such accelerators require the generation of the high DC current which is typically utilized to charge an inductor. The inductor is then abruptly discharged to pump DC current of an extremely high magnitude into the accelerator in which the mass to be accelerated is situated. The flow path of this current and its attendant magnetic field can be made to interact in ways well known in the art to exert tremendous propulsion forces on the mass to achieve extraordinary exit velocities. The conversion from the inductor charging mode to the inductor discharging mode requires the commutation of current flow, hence the need for a high DC current switch.

The desire to increase the exit velocity of ever larger masses obviously requires more energy and thus higher DC current levels which must be switched. A switch capable of commutating DC currents of hundreds of thousands of amperes and even megamperes, as has been proposed, must be extremely fast acting and able to cope with the tremendous arcing involved.

It is accordingly an object of the present invention to provide an improved high DC current switch.

A further object is to provide a high DC current switch of the above-character which is capable of extremely high actuating speeds.

An additional object is to provide a high DC current switch of the above-character wherein the switching member thereof is accelerated into its switching motion electromagnetically.

Other object is to provide a high DC current switch of the above character wherein the switching motion of its switching member is decelerated to a stop electromagnetically.

Yet another object is to provide a DC current switch of the above-character which is capable of handling the violent arcing associated with switching high DC currents.

A still further object is to provide a high DC current switch which is compact in size, efficient to manufacture and reliable in operation.

Other objects of the invention will in part be obvious and in part appear hereinafter.

SUMMARY OF THE INVENTION

In accordance with the present invention there is provided a high DC current switch of the rotary type having opposed, annular, electromagnetically actuating rails for routing DC current generated by a suitable source to and from a brush assembly mounted for circular motion therebetween. The brush assembly includes a pair of brushes mounted as a unit in electrically insulated relation. With the brush assembly detained in a home position by a retractable stop, DC current is routed to and from the pair of brushes by the rails in directions effective in exerting electromotive forces on the brush assembly in a forward angular direction. When the DC current reaches a desired magnitude, the stop is retracted, and the brush assembly is accelerated into its switching motion. At corresponding angular locations, each rail incorporates an insulative switching gap, beyond which each rail is split into inner and outer arcuate rail sections insulated from each other. One of these rail sections is common to its rail, while the other section is electrically connected to the circuit path into which DC current is to be switched.

Upon arrival of the brush assembly at the rail switching gap, the flow of current through the brush pair between the rails is interrupted accompanied by violent arcing. Momentum carries the brush assembly through the switching gap where the brushes moves into separate sliding contact with the respective inner and outer arcuate sections of the opposed rails. The arc voltages restore the flow of DC current which is now switched into those circuit paths to which the inner arcuate section of one rail and the outer arcuate section of the other rail are connected. The directions of current flow in these rail sections to and from the individual brushes is now effective in exerting electromotive forces on the brush assembly in the reverse angular direction, thus rapidly decelarating the brush assembly to a stop as the flow of DC current subsides. A suitable indexing means is then actuated to move the brush assembly a short distance in the forward angular direction to its home position, ready for another switching cycle.

The invention accordingly comprises the combination of elements, arrangement of parts and features of construction which will be exemplified in detailed description hereinafter set forth, and the scope of the invention will be indicated in the claims.

For a better understanding of the nature and objects of the invention, reference should be had to the following detailed description taken in conjunction with the accompanying drawings, in which.

Like reference numerals refer to corresponding parts throughout the several views of the drawings.

DETAIL DESCRIPTION

Figure 1:
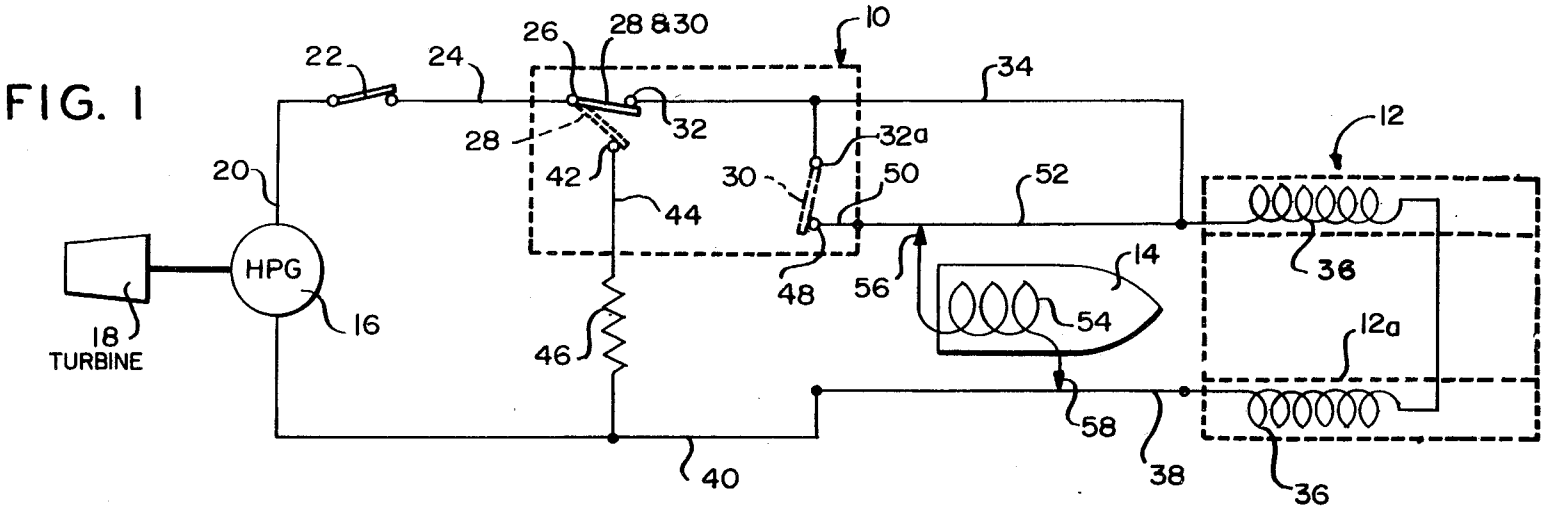
FIG. 1 is a schematic diagram of a mass accelerator circuit utilizing the high DC current switch of the present invention.

Referring first to FIG. 1, the high DC current switch, generally indicated at 10, is shown schematically in its application in a circuit for energizing an accelerator, generally indicated in phantom at 12, operating to propel a mass 14 to extremely high velocities. To develop the requisite high magnitude of DC current a suitable source, typically a acyclic or homopolar generator 16, is driven up to speed by an appropriate prime mover, such as a turbine 18. The upper output terminal of generator 16 is connected by a bus 20, a make switch 22 and a bus 24 to a terminal 26 of high current switch 10. In the illustrated solid line switch condition, current is routed by a pair of movable contacts 28 and 30 to a switch terminal 32. As will be seen in FIGS. 2 through 4, these switch contacts correspond to a pair of rotary mounted brushes indicated by the same reference numerals. From switch terminal 32, current is conveyed by a bus 34 to charge an inductor 36 whose coils are distributed out and back along the length of the accelerator tube, indicated in phantom at 12*a*. The current return path from inductor 36 is through a breech conductive rail 38 and a bus 40 to the other terminal of homopolar generator 16.

Still referring to FIG. 1, high current switch 10 further includes a terminal 42 which is connected by a bus 44 to the upper end of a resistor 46, whose lower end is connected to bus 40. Swich terminal 32*a* is seen to be common with switch terminal 32. The last switch terminal is indicated at 48 and is seen to be connected by a bus 50 to a breech conductive rail 52 situated in opposed, spaced relation to breech rail 38. Guideably mounted for movement between these breech rails is mass 14 which is illustrated as carrying a bucket coil 54 with its ends terminating in brushes 56 and 58 in sliding electrical contact with rails 52 and 38, respectively.

When the current developed by generator 16 for charging inductor 36 achieves its maximum magnitude, switch 10 assumes its phantom line condition with contact 28 bridging switch terminals 26 and 42 to connect resistor 46 across the output terminals of generator 16 and dissipate the energy remaining in the generator as its field winding is de-energized. At the same time, switch contact 30 bridges switch terminals 32*a* and 48. This is seen to connect bucket coil 54 in a series circuit loop with inductor 36, and the latter begins to discharge. The interaction of the magnetic fields developed by the high DC inductor discharge current flowing in breech rails 52, 38 and bucket coil 54 produces electromotive forces propelling mass 14 to the right into the breech of barrel 12*a*. At this point, bucket coil brushes 52 and 58 move into sliding electrical contact with the coils or turns of indicator 36 distributed along the accelerator length. Thus the inductor now discharges directly through bucket coil 54. The electromotive forces resulting from the interaction of the magnetic fields associated with this high DC discharge current flowing through the inductor turns and the bucket coil turns rapidly accelerates mass 14 through barrel 12*a* to a very high exit velocity.

Figure 2:
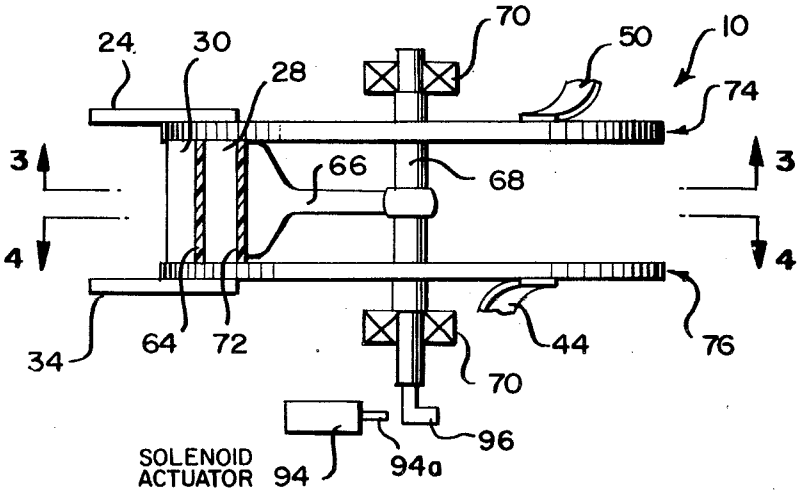
FIG. 2 is a side elevational view of the high DC current switch of the present invention.

The structural features of high DC current switch 10 will now be described with specific references to FIGS. 2 through 4. As will be seen from the description to follow, switch 10 is actually a so-called "rail" switch which is operated by electromotive forces developed as in a simple rail gun. Thus, as best seen in FIG. 2, a brush assembly, generally indicated at 60, which include a pair of brushes 28 and 30 which correspond to switch contacts 28 and 30 of FIG. 1. These brushes may each consist of a multiplicity of thin copper sheets 62 (FIGS. 3 and 4) held in stacked relation. An insulative barrier 64 maintains brushes 28 and 30 electrically isolated from each other. The brush assembly is mounted by an arm 66 to a shaft 68 suitably journalled in bearings 70. An insulative barrier 72 electrically isolates brush assembly 60 from its rotary mounting arm 66.

Brush assembly 60 revolves between an upper conductive rail, general indicated at 74, and a lower conductive rail, generally indicated at 76, which are mounted in superimposed, parallel, spaced relation by suitable means (not shown). It will be appreciated that the switch spatial orientation shown in merely illustrative. FIG. 3 shows rail 74 in plan view with brush assembly 60 below it, while FIG. 4 is a plan view of rail 76 with the brush assembly above it. As seen in these views, rails 74 and 76 are of an annular configuration and provide smooth, opposed conductive surfaces against which brushes 28 and 30 slidingly engage. Bush assembly 60 is shown residing in a "home" position and restrained from counter clockwise movement by a retractable stop 78. At a suitable angular location approximately 150 to 170 degrees counterclockwise from this home position, the electrical continuity of rails 74 and 76 is interrupted by switching gaps, generally indicated at 80 in FIGS. 3 and 4. These switching gaps preferably are constituted by an arc resistant segment 82 of a suitable ceramic material immediately followed in the counter clockwise direction by a segment 84 of suitably highly insulative material. However, each switching gap may be consititutted by a single segment of an insulative ceramic material. These segments are incorporated in the rails such that their surfaces are flush with the rail conductive surfaces leading up to the switching gaps 80. Beyond its switching gap rail 74 is radially split into an inner arcuate rail section and an outer arcuate rail section, the latter being insulated from the former by an inlaid insulative strip 86. This inner arcuate rail section is integral with and thus electrically common to the unsplit arcuate conductive section of rail 74, and, as will be seen, both sections correspond to switch terminal 26 of FIG. 1. Consequently these sections of rail 74 are so referenced in FIG. 3. The outer arcuate rail section of rail 74 will be seen to correspond to switch terminal 48 in FIG. 1 and is likewise referenced in FIG. 3.

Figure 4:
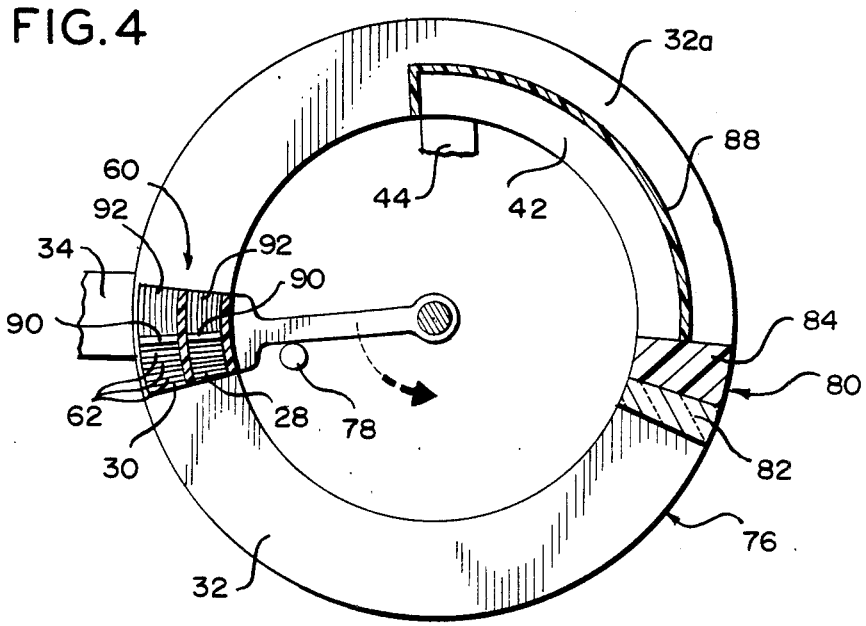
FIG. 4 is a sectional view taken along line 4—4 of FIG. 2.

Rail 76 of FIG. 4 beyond its switching gap 80 is similarly radially split into an inner arcuate rail section and an outer arcuate rail section insulated from each other by an inlaid insulative strip 88. The outer arcuate rail section is integral with and thus electrically common to the unsplit arcuate section of rail 76. As will be seen, this short outer arcuate section and the long, unsplit arcuate section of rail 76 respectively correspond to the electrically common switch terminals 32*a* and 32, and thus these rails sections are so referenced in FIG. 4. The short inner arcuate section of rail 76 will be seen to correspond to switch terminal 42 in FIG. 1 and is so referenced.

Figure 3:
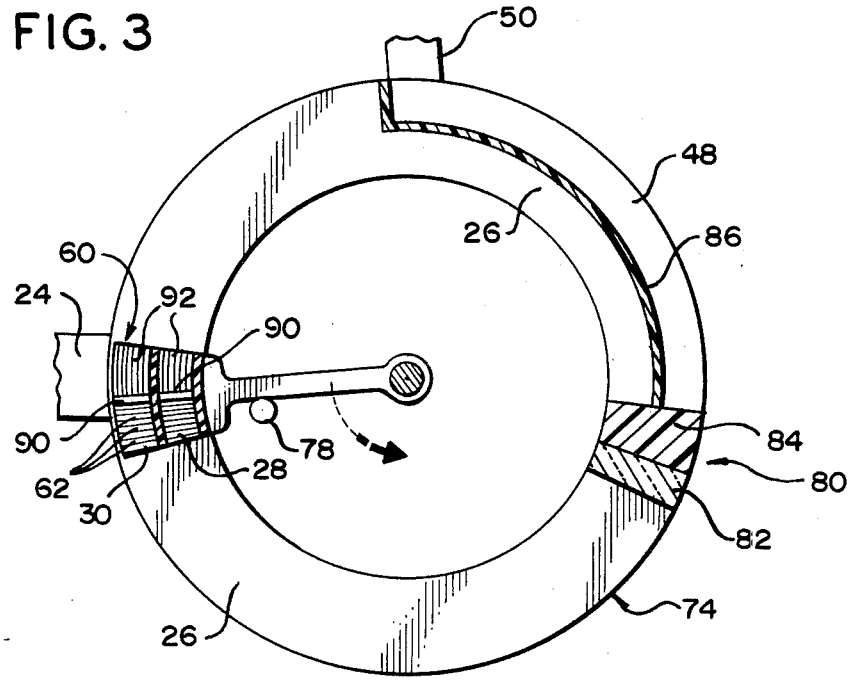
FIG. 3 is a sectional view taken along line 3—3 of FIG. 2.

As seen in FIGS. 2 and 3, the conductive arcuate sections of rail 74 consituting switch terminal 26 are electrically connected with current bus 24, while short outer arcuate section (switch terminal 48) is electrically connected with bus 50. It is seen that these switch terminal connections correspond to that shown in FIG. 1. Referring to FIGS. 2 and 4, the arcuate sections of rail 76 constituting common switch terminal 32, 32*a* are electrically connected with bus 34, while the short inner arcuate rail section constituting switch terminal 42 is electrically connected with bus 44. These switch terminal connections are seen to correspond to those shown in FIG. 1.

Completing the description of the switch structure seen in FIGS. 3 and 4, brush assembly 60 further includes arc horns 90 of a suitable refractory material such as tungsten spanning the trailing edges of brushes 28 and 30. Beyond these arc horns are positioned ceramic arc chutes 92 of the type utilized in circuit breakers which together serve to control and extinguish the arcing incident to commutating the high DC current handled by switch 10.

Considering the operation of switch 10 in detail, while generator 16 is being driven up to speed by turbine 18, its current output flows through bus 24 into the arcuate section of rail 74 consituting switch terminal 26. This current flows a short distance in the counter clockwise direction through rail 74 to the point where brushes 28, 30 of brush assembly 60 in its home position pick off the current and route it to the arcuate section of rail 76 constituting switch terminal 32. It is seen that the current has to flow in the opposite or clockwise direction in rail 76 to reach bus 34 through which it flows to charge inductor 36 (FIG. 1). These opposing rail current directions set up a magnetic field which interacts with the current flowing through brushes 28, 30 to develop electromotive forces on brush assembly 60 exerted in the counterclockwise direction. However, the brush assembly is detained in its home position by stop 78 until the current developed by generator 16 approaches its crest magnitude. At that moment, stop 78 is retracted, and the brush assembly is rapidly accelerated in the counterclockwise direction toward switching gap 80. As the momentum of the brush assembly carries it swiftly through the switching gap, DC current flow is interrupted. The consequent arcing is controlled by arc horns 90 and arc chutes 92 of the bush assembly and ceramic rail segments 82 to prevent arc damage to switch 10. As the brush assembly 60 leaves the switching gap, it is seen that brush 28 makes bridging contact between the short radially inner arcuate sections of rails 74 and 76 (respectively switch terminals 26 and 42) while brush 30 makes bridging contact between the short radially outer arcuate sections thereof (respectively switch terminals 48 and 32*a*). The arc voltages are effective to abruptly commutate the current into new, split current paths; one including resistor 46 now connected across generator 16 via brush 28 bridging switch terminals 26 and 28 bridging switch terminals 26 and 42, and the other being the circuit loop of inductor 36 and bucket coil 54 via brush 30 bridging switch terminals 32*a* and 48. At this time, because of switching gaps 80, it is seen that the DC rail current flows from bus 24 through rail 74 to brush 28 in the clockwise direction and from this brush through rail 76 in the opposite or counterclockwise direction to bus 44. In contrast to the situation where the rail currents enter and leave the brush assembly from its trailing side to thus accelerate it away from its home position, the rail currents now enter and leave the brush assembly from its leading side. Consequently, decelerating forces are exerted on the brush assembly effective in bringing it to a stop as the generator current through resistor 46 and the inductor discharge current subside. To advance brush assembly 60 in the counterclockwise direction back to its home position, suitable indexing means such as solenoid actuator 94 whose plunger 94*a* engages an arm 96 affixed to shaft 68 to reset switch 10 by advancing the brush assembly counterclockwise to its home position, as seen in FIG. 2.

It is thus seen that the present invention provides a high DC current switch in the form of a rotary rail switch whose switch operator is electromagnetically accelerated from a standing start position into a switching cycle and electromagnetically decelerated to a stop to conclude the switching cycle. The switch operator is thus moving at a high velocity at the moment of high DC current commutation, and consequently the task of controlling the attendant arcing to extinction is made easier. Since the switch operator moves in rotary fashion, returning it to its start or home position involves advancing it a short distance in the same angular direction in which it moved through the switching cycle. Thus, the switch of the present invention is capable of executing switching cycles in rapid succession.

It will thus be seen that the objects set forth above, including those made apparent in the preceding description, are efficiently attained and, since certain changes may be made in the above construction without departing from the scope of the invention, it is intended that all matters contained in the accompanying drainings shall be interpreted as illustrative and not in a limiting sence.

Having described the invention, what is claimed as new and desired to be secure by Letter Patent is:

1. A high DC current switch comprising, in combination:

A. first and second annular conductive rails disposed in substantially superimposed, spaced relation to present first and second opposed, parallel surfaces, respectively, said first rail including a first arcuate rail section electrically insulated from the remainder of said first rail;

B. a brush assembly mounted for rotary movement from a home position in a first angular direction, said brush assembly disposed between said first and second rails in sliding electrical contact with said first and second surfaces for conducting DC current between said first and second rails;

C. a switching gap incorporated in said first and second rails; and

D. electrical connections with said first and second rails and said first arcuate rail section for routing DC current through said second rail and one of said first rail and said first arcuate rail section to and from said brush assembly in directions to electromotively accelerate said brush assembly in said first angular direction away from said home position toward said switching gap and for routing DC current through said second rail and the other one of said first rail and first arcuate rail section to and from said brush assembly in directions to electromotively decelerate the rotary movement of said brush armature beyond said switching gap, whereby said brush assembly is brought to a stop proximate said home position to conclude a switching cycle.

2. The high DC current switch defined in claim 1, which further includes a stop for releasably detaining said brush assembly in said home position.

3. The high DC current switch defined in claim 1, which further includes means for advancing said brush assembly in said first angular direction from its stopped position at the conclusion of a switching cycle to said home position.

4. The high DC current switch defined in claim 1, wherein said brush assembly carries means for controlling to extinction the arcing produced during movement thereof through said switching gap.

5. The high DC current switch defined in claim 1, wherein said brush assembly includes first and second brushes mounted in electrically insulated, radially side-by-sided relation.

6. The high DC current switch defined in claim 5, wherein said second rail includes a second arcuate rail section situated immediately beyond said switching gap in said first angular direction and electrically insulated from the remainder of said second rail, said first and second arcuate rail sections being radially offset from each other, whereby DC current is commutated from said second rail to said first arcuate rail section by said first brush and from said first rail to said second arcuate rail section by said second brush.

7. The high DC current switch defined in claim 6, which further includes a stop for releasably detaining said brush assembly in said home position.

8. The high DC current switch defined in claim 7, which further includes means for advancing said brush assembly in said first angular direction from its stopped position at the conclusion of a switching cycle to said home position.

9. The high DC current switch defined in claim 7, wherein said brush assembly carries means for controlling to extinction the arcing produced during movement thereof through said switching gap.

10. A switch for commutating high DC currents in a circuit including a DC current generator, an energy storage inductor, and a mass accelerator, said switch comprising, in combination:

A. first and second annular conductive rails disposed in substantially superimposed, spaced relation to present first and second opposed, parallel surfaces, respectively, said second rail including a second arcuate rail section electrically insulated from the remainder of said second rail;

B. a brush assembly mounted for rotary movement from a home position in a first angular direction, said brush assembly disposed between said first and second rails in sliding electrical contact with said first and second surfaces to conduct DC current between said first and second rails;

C. a switching gap incorporated in said first and second rails; and

D. separate electrical connections with said first and second rails and said second arcuate rail section for routing DC charging current from said generator to said inductor through said first and second rails in directions to and from said brush assembly such to electromotively accelerate said brush assembly in said first angular direction away from said home position toward said switching gap, said electrical connections further routing DC generator current through said first rail and said second arcuate rail section in directions to and from said brush assembly such as to electromotively decelerate the rotary movement of said brush assembly beyond said switching gap, whereby said brush assembly is brought to a stop proximate said home position to conclude a switching cycle.

11. The switch defined in claim 10, which further includes a stop for releasably detaining said brush assembly in said home position.

12. The switch defined in claim 10, which further includes means for advancing said brush assembly in said first angular direction from its stopped position at the conclusion of a switching cycle to said home position.

13. The switch defined in claim 10, wherein said brush assembly carries means for controlling to extinction the arcing produced during movement thereof through said switching gap.

14. The switch defined in claim 10, wherein said brush assembly includes first and second brushes mounted in electrically insulated, radially side-by-sided relation.

15. The switch defined in claim 14, wherein said second arcuate rail section is situated immediately beyond said switching gap in said first angular direction and said first rail includes a first arcuate rail section situated immediately beyond said switching gap in said first angular direction and electrically insulated from the remainder of said first rail, said first and second arcuate rail sections being radially offset from each other, and said separate electrical connections include a first electrical connection of said first rail to said generator, a second electrical connection of said second rail to said inductor, and a third connection of said first arcuate rail section to said accelerator, whereby said first and second brushes conduct inductor charging current between said first and second rails during movement of said brush assembly from said home position to said switching gap, and said first brush conducts inductor discharging current from said second rail to said first arcuate rail section during movement of said brush assembly beyond said switching gap in said first angular direction.

16. The switch defined in claim 15, wherein the circuit further includes a resistor connected with said generator, and said electrical connections include a fourth connection of said second arcuate rail section with said resistor, whereby during movement of said brush assembly beyond said switching gap in said first angular direction, said second brush routes generator current to said resistor from said first rail to said second arcuate rail section.

* * * * *